United States Patent [19]

Müller et al.

[11] Patent Number: 4,838,048

[45] Date of Patent: Jun. 13, 1989

[54] KNITTING MACHINE

[75] Inventors: Gerhard Müller, Esslingen 1; Werner Engelfried, Sindelfingen, both of Fed. Rep. of Germany

[73] Assignee: Terrot Strickmaschinen GmbH, Stuttgart, Fed. Rep. of Germany

[21] Appl. No.: 142,541

[22] Filed: Jan. 11, 1988

[30] Foreign Application Priority Data

Jan. 22, 1987 [DE] Fed. Rep. of Germany ..... 3701743

[51] Int. Cl.[4] ..... D04B 15/78

[52] U.S. Cl. ..... 66/220; 66/222

[58] Field of Search ..... 66/25, 75.2, 218, 219, 66/220, 221, 222

[56] References Cited

U.S. PATENT DOCUMENTS 3,892,108 7/1975 Hadam ..... 66/75.2
4,023,383 5/1977 Klinger ..... 66/220 X

FOREIGN PATENT DOCUMENTS 2327585 12/1974 Fed. Rep. of Germany ..... 66/220
2424190 12/1975 Fed. Rep. of Germany ..... 66/219
135222 4/1979 German Democratic Rep. ... 66/220

*Primary Examiner*—Wm. Carter Reynolds
*Attorney, Agent, or Firm*—Shenier & O'Connor

[57] ABSTRACT

A knitting machine with stitch-forming knitting needles which are actuated by pattern bars and which are adjustable in accordance with the three-way technique to three operating positions, i.e., the knitting, floating and tucking positions, comprises electromagnetic selector means which are controlled in accordance with a pattern to adjust the knitting needles to their operating positions and also eccentric steering means which cooperate with these selector means. Arranged in each pattern bar are two displaceable selector elements which are biased by a spring and which are adjustable by cooperation of the electromagnetic selector means and the spring so as to be brought in accordance with a pattern or combination into the path of steering cam means trigger displacement of the selector elements and hence pivotal motion of the pattern bar in accordance with the desired operating position.

10 Claims, 3 Drawing Sheets

FIG. 2
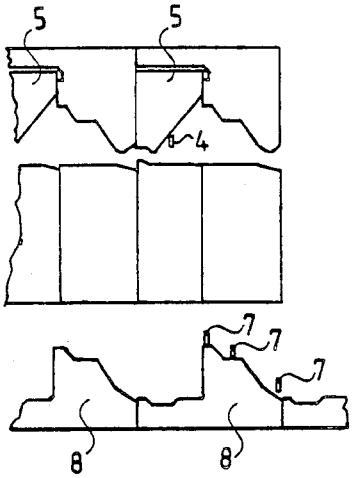
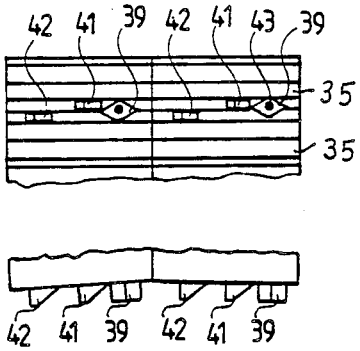
FIG. 3
FIG. 1
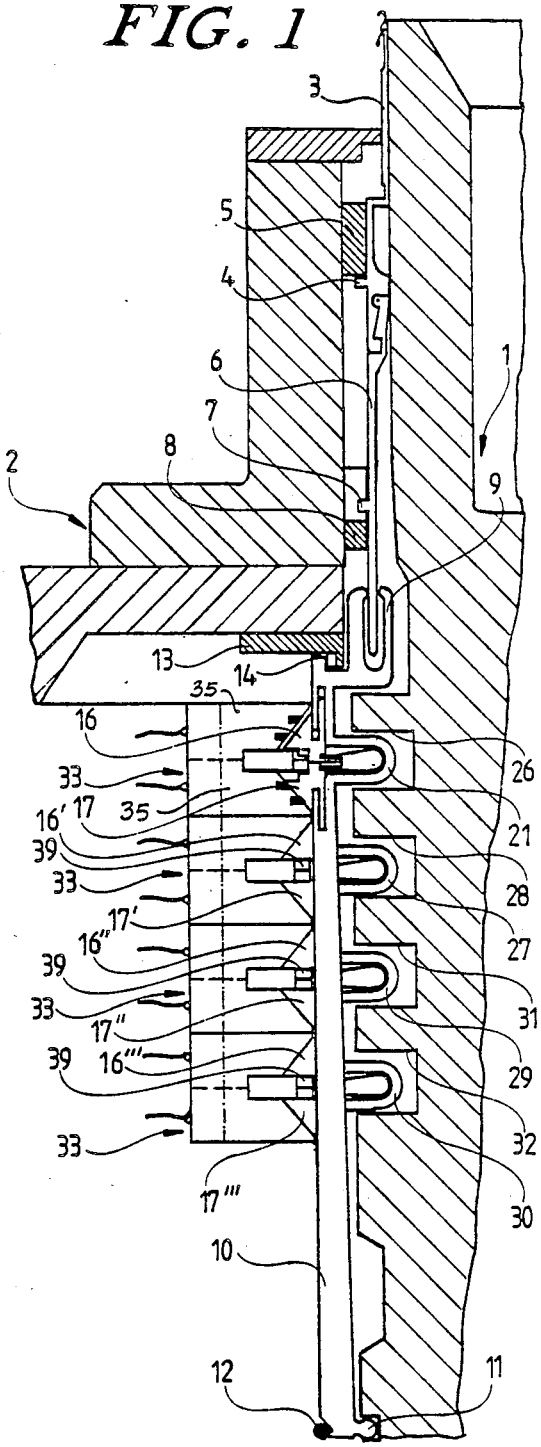

KNITTING MACHINE

The invention relates to a knitting machine with stitch-forming knitting needles which are actuated by pattern bars and which are adjustable in accordance with the threeway technique to three operating positions, i.e., the knitting, floating and tucking positions, with electromagnetic selector means which are controlled in accordance with a pattern to adjust the knitting needles to their operating positions and with eccentric steering means which cooperate with the selector means.

A knitting machine of this kind is known, for example, from U.S. Pat. No. 3,861,173. However, in this older knitting machine, the magnetic selector means engage the pattern bars directly, which means that the occurrence of inaccurate response of the assembly in accordance with a pattern has to be tolerated. As a result of this the knitting machine can only be operated at a relatively slow operating speed.

The object of the invention is to provide a generic knitting machine with a pattern device which responds more precisely, thereby enabling higher operating speeds to be attained.

The object is achieved, in accordance with the invention, in that (1) a first and a second selector element are displaceably mounted in each pattern bar;

(2) the selector elements are biased into an initial position by a spring which is likewise arranged in the pattern bar;

(3) an eccentric steering means urges both selector elements against the biasing into a first position which triggers the knitting position of the knitting needles and in which they are held by the electromagnetic selector means in accordance with a pattern;

(4) a first steering cam means is associated with the first selector element in order to bring the first selector element which has been pushed back, in accordance with a pattern, by the electromagnetic selector means and the spring into its initial position, and along with it the pattern bar, into a second position which triggers the floating position of the knitting needles; and (5) a second steering cam means is associated with the second selector element in order to bring the second selector element which has been pushed back, in accordance with a pattern, by the electromagnetic selector means and the spring into its initial position, and along with it the pattern bar, into a third position which triggers the tucking position of the knitting needles.

The following description of preferred embodiments serves in conjunction with the appended drawings to explain the invention in further detail. In the drawings:

FIG. 1 shows schematically an axial, part-sectional view of a knitting machine;

FIG. 2 shows schematically cam parts of the knitting machine of FIG. 1;

FIG. 3 shows in front and plan views eccentric steering means and steering cam means for steering pattern bars;

Figure 4:
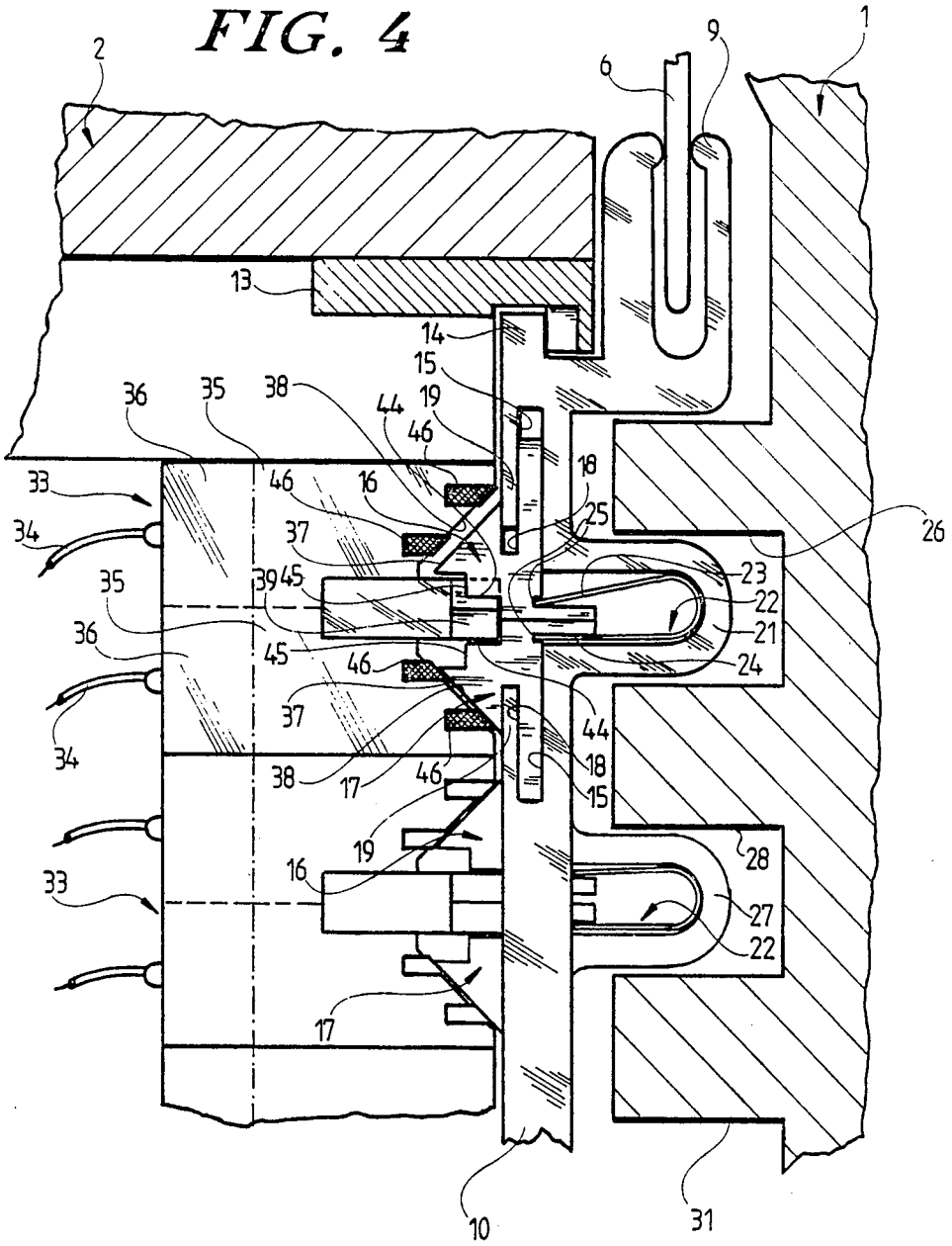
FIG. 4 shows a part-sectional view which is an enlargement of FIG. 1.

The knitting machine illustrated schematically and only in part in FIG. 1 comprises, in the conventional manner, a rotatably mounted needle cylinder 1 which is surrounded by a stationary cam ring 2 consisting of several parts. Knitting needles 3 are slidingly arranged, in the conventional manner, on the outer side of the needle cylinder 1 in longitudinal slots arranged alongside one another. Each knitting needle 3 comprises a steering butt 4 which cooperates with a cam part 5 to bring about the downward motion of the knitting needle (see also FIG. 2). Each knitting needle is connected, in the conventional manner, at its lower end to a pusher means 6 comprising a steering butt 7. This steering butt 7 cooperates with a cam part 8 which triggers the upwardly oriented, drive-out motion of the pusher means 6 and the knitting needle 3 connected to it (see FIG. 2). The lower end of the pusher means 6 is slidingly accommodated in a fork-shaped claw 9 of a pattern bar 10 which with a projection 11 at its bottom end is pivotably mounted in a groove of the needle cylinder 1 and which, together with the pattern bars arranged beside it, is held on the needle cylinder 1 by a helical spring 12 peripherally surrounding this cylinder. When the pattern bar 10 is swivelled to the right, out of the position illustrated in FIG. 1, in the clockwise direction, about the projection 11 acting as fulcrum, the pusher means 6 is taken along and, therefore, its steering butt 7 becomes disengaged from the cam part 8, whereby the upward motion of pusher means 6 and knitting needle 3 is prevented or interrupted. The knitting needle 3, therefore, remains in a certain position in relation to the needle cylinder 1 and is then later returned to the initial position again by the cam part 5 engaging the steering butt 4. In this way, any desired knitting patterns (colored designs or knitting combinations) can be produced in the conventional manner by correspondingly steering the pattern bars 10.

An eccentric return means 13 which is fixedly connected to the cam ring 2 cooperates with a steering butt 14 on the pattern bar 10 and guides the pattern bar 10 back into the initial position illustrated in FIG. 1 in a manner known per se.

As is best seen from the enlarged view in FIG. 4, a first and a second selector element 16 and 17, respectively, are mounted for sliding displacement in the longitudinal direction of the pattern bar 10 in slots 15 of the pattern bar 10. As illustrated, the selector elements 16, 17 also comprise slots 18 in which webs 19 which delimit the slot 15 of the pattern bar 10 engage and improve the sliding guidance.

The pattern bar 10 comprises in the region of the selector elements 16, 17 a bulge 21 oriented towards the axis of rotation of the needle cylinder 1. Arranged in this bulge is a U-shaped spring 22 with two free legs 23, 24. The spring is so designed that normally the free ends of the legs 23, 24 are made to abut each other by a biasing force. The free ends of the legs 23, 24 engage notches 25 of the selector elements 16, 17 and due to the biasing effect of the spring 22 hold the two selector elements 16, 17 together, as illustrated in FIG. 4. The bulge 21 of the pattern bar 10 which accommodates the spring 22 is, in turn, accommodated in a corresponding groove 26 in the needle cylinder 1. Instead of a U-shaped spring 22, other springs which act in the same way, for example, bar springs, torsion springs, helical springs or the like could also be used.

On the next pattern bar which in FIGS. 1 and 4 is arranged behind the illustrated pattern bar 10, the bulge 27 corresponding to the bulge 21 is located at a lower level and extends into a groove 28 arranged below the groove 26. Again, the bulge 27 accommodates a U-shaped spring 22 which cooperates with selector elements 16, 17 of the next pattern bar which in FIG. 4 is located below the visible bar 10. As FIG. 1 shows, four pattern bars 10 arranged behind one another comprise bulges 21, 27, 29 and 30 which are arranged in corresponding grooves 26, 28, 31 and 32, respectively, of the needle cylinder 1 and which accommodate U-shaped springs 22 cooperating with associated selector elements 16, 17.

Electromagnetic selector means 33 whose mode of operation will be explained below, cooperate with each pair of selector elements 16, 17 in one pattern bar 10, in each case. As is apparent from FIG. 1, there is associated with each of the four pattern bars 10 arranged behind one another, one electromagnetic selector means 33 which, in each case, is attached at the level of the respective bulge 21, 27, 29 and 30 to the cam ring 2 of the knitting machine. With the above-described superimposed arrangement of several electromagnetic selector means 33 per knitting location, longer functioning times of the magnets are obtained by alternate switching of these selector systems, which results in more precise control of the pattern bars.

The electromagnetic selector means 33—see, in particular, FIG. 4—are activated in a known manner via control lines 34. In the preferred embodiment of the invention, the electromagnetic selector means 33 comprise permanent magnets 35 which directly engage the selector elements 16, 17 and with which electromagnets 36 are associated, in each case. The geometrical arrangement of the permanent and electromagnets is such that each electromagnet 36 can attenuate and possibly also amplify the effect of the permanent magnet associated with it. In other embodiments of the invention, the electromagnetic selector means may also be of different design.

In the embodiment shown in FIG. 4, the selector elements 16, 17 which are displaceable in the pattern bar 10 comprise surfaces 37 which extend at an incline to their direction of displacement and can cooperate with correspondingly inclined surfaces 38 of the magnets 35. In FIG. 4, the magnet 35 located at the top is inoperative. Accordingly, the first selector element 16 at the top is pushed downwardly by the action of the U-shaped spring 22. The magnet 35 which in FIG. 4 is located below the top magnet is assumed to be operative. The two inclined surfaces 37, 38 of the second selector element 17 and the magnet 35, respectively, are held against each other by the force of the magnet and so the second selector element 17 is pushed downwardly against the biasing effect of the spring 22.

An eccentric steering means 39, a first steering cam means 41 and a second steering cam means 42 whose configuration and arrangement are best apparent from FIG. 3, cooperate with the selector elements 16, 17 in each pattern bar 10 which control production of the pattern. The eccentric steering means 39 has the shape of a rhombohedron and can be suitably adjusted on the cam ring 2 by means of a screw 43. Each of the selector elements 16, 17 comprises an edge or surface 44 which extends perpendicularly to its direction of displacement and cooperates in such a manner with corresponding inclined surfaces of the eccentric steering means 39 when the needle cylinder 1 rotates relative to the cam ring 2 that the eccentric steering means 39 pushes the two selector elements 16, 17 apart against the action of the spring 22 and brings them into contact with the associated magnets 35 where the selector elements are held by appropriate activation of these magnets. This position of the selector elements 16, 17 corresponds to the knitting position of the knitting needles 3, i.e., in this position of the selector elements, swivelling of the pattern bar 10 does not occur and the steering butt 7 of the pusher means 6 remains in contact with the cam part 8 and so the respective knitting needle 3 is driven out to the full extent.

If, at the right point in time, for example, the top magnet arrangement in FIG. 4 is so controlled via control line 34 that there is an attenuated or no more magnetic effect at the inclined surface 38 of the magnet 35, the leg 23 of the U-shaped spring 22 then draws the selector element 16 downwardly and so an edge or surface 45 provided on it and extending parallel to the direction of displacement of the selector element and perpendicularly to the edge or surface 44 is brought into contact with the steering cam means 41 which thereby displaces this selector element 16 (to the right in FIGS. 1 and 4). This causes the pattern bar 10 connected to the selector element to be swivelled and so the steering butt 7 of the pusher means 6 becomes disengaged from the cam part 8. The knitting needle 3 is, therefore, prevented from being driven out and remains in the floating position. The bottom selector element 17 in FIG. 4 is released from the magnet arrangement 35, 36 holding it by the above-described mechanical displacement force exerted by the steering cam means 41 on the selector element 16 and hence also on the pattern bar 10.

If, in contrast with the previously described control procedure, the two top magnet arrangements 35, 36 in FIG. 4 are so controlled that the magnet engaging the bottom or second selector element 17 loses its magnetic effect, the leg 24 of the U-shaped spring 22 pushes the selector element 17 upwardly and so its edge or surface 45 comes into contact with the second steering cam means 42. This steering cam means 42 interrupts (at a later point in time than steering cam means 41) the drive-out motion of the knitting needle and so it now remains in the tucking position. (At the bottom of FIG. 2, the three possible operating positions of the knitting needle 3, i.e., the floating, tucking and knitting positions, are indicated from the right to the left with the aid of the steering butts 7.)

With the described assembly, rapid and precise response of the selector elements 16, 17 and hence the pattern bars 10 can be brought about by correspondingly controlling the electromagnetic selector means 33 in cooperation with the U-shaped spring 22. In particular, the spring 22 is advantageous because it enables rapid release of the selector elements from the magnets. Also, the previously mentioned arrangement of several electromagnetic selector means 33 below one another, with each cooperating with correspondingly positioned selector elements 16, 17 is expedient.

As is best apparent from FIG. 4, strips 46 made of wear-resistant material, for example, glass, ceramic or plastic material are inserted into the inclined surfaces 38 of the magnets 35 and protrude with their front, inclined edges somewhat beyond the surfaces 38. The selector elements 16, 17 slide along these strips 46 when they are attracted by the magnets 35 and the needle cylinder 1 rotates relative to the cam ring 2.

In the described embodiment (see, in particular, FIG. 4), the inclined surfaces 37, 38 on the selector elements 16, 17 and the magnets 35, respectively, create a larger, magnetically effective contact region than surfaces which extend perpendicularly to the direction of displacement of the selector elements 16, 17. A further advantage of these inclined surfaces over surfaces extending perpendicularly to the direction of displacement of the selector elements is that slight deviation of the pattern bars 10 in the tilting direction is thereby enabled, which permits greater manufacturing tolerances in the manufacture of the selector elements and the pattern bars. This deviation of the pattern bar in the tilting direction is, of course, so slight that the steering butt 7 of the pusher means 6 does not thereby become disengaged from the cam part 8.

Figure 5:
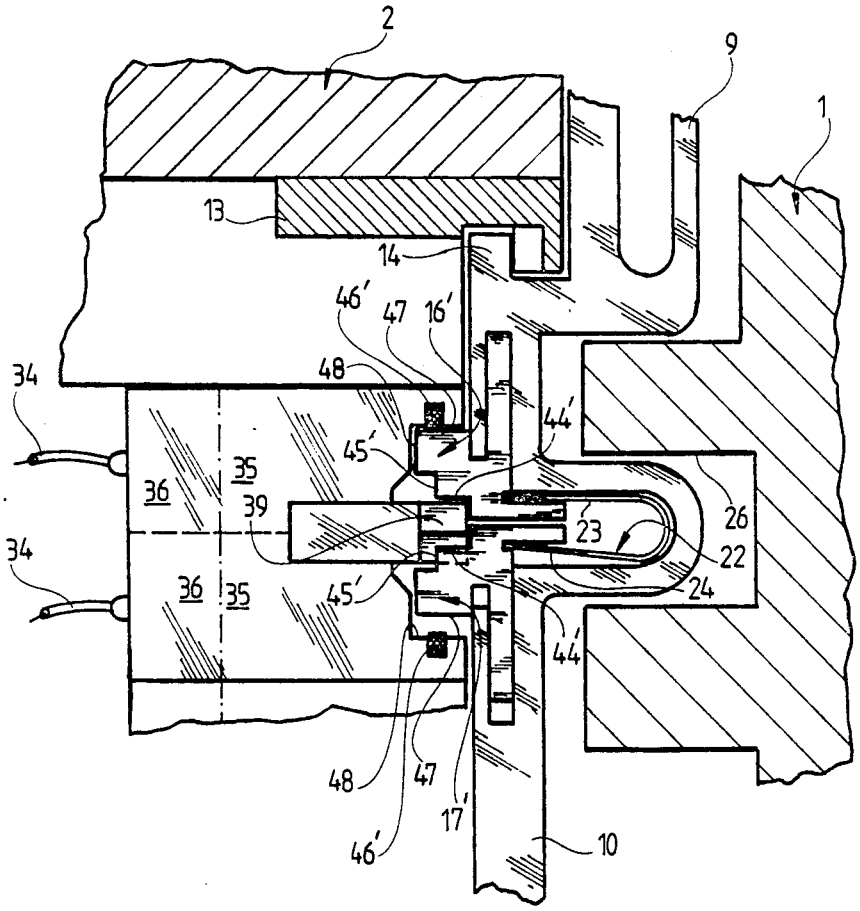
FIG. 5 shows a part-sectional view similar to FIG. 4 of another embodiment.

In spite of the above-mentioned advantages of the inclined surfaces 37, 38, surfaces which extend perpendicularly to the direction of displacement of the selector elements can also be used. This is illustrated in another embodiment of the invention in FIG. 5 in which corresponding parts are designated by the same reference numerals as in FIGS. 1 to 4. As illustrated, the two selector elements 16', 17' comprise edges or surfaces 47 which extend perpendicularly to their direction of displacement and cooperate with surfaces 48 extending parallel thereto on the magnets 35. As is evident, the end position of the selector elements 16', 17' and hence of the pattern bar 10 is fixed in a definite manner, in this design, by these surfaces 47, 48 contacting each other. FIG. 5 also differs from FIG. 4 in that the first selector element 16' is in its inoperative position, whereas the second selector element 17' has been released from the associated magnet 35 and brought by the action of the spring 22 into the path of the second steering cam means 42 (FIG. 3) and so the knitting needle 3 associated with the pattern bar 10 comes into the tucking position.

When (in both embodiments shown in FIGS. 4 and 5) both magnet arrangements associated with the selector elements 16, 17 or 16', 17' are operative and hold the selector elements in abutment with the surfaces 38 and 48, respectively, against the biasing effect of the spring 22, the selector elements 16, 17 or 16', 17' are pushed so far apart and are at such a distance from each other that the edges 45 or 45' pass by the respective steering cam means 41, 42 and these steering cam means do, therefore, not become operative. As explained above, this means that the knitting needles 3 can come into the knitting position.

What is claimed is:

1. A knitting machine including in combination a plurality of stitch-forming needles (3) selectively adjustable for movement to one of a knitting, floating and tucking operation positions in operation of said machine, pattern bars (10) for adjusting said needles, first and second selector elements (16, 17) displaceably mounted on each of said pattern bars (10), a spring (22) on each of said pattern bars for biasing the selector elements (16, 17) of the bar to an initial position, an eccentric steering means (39) for urging both selector elements (16, 17) of a bar (10) against the biasing action of the associated spring (22) to first positions which trigger the knitting position of the knitting needles (3), electromagnetic selector means (33) controlled in accordance with a pattern for releasably holding said selector elements (16, 17) in said first positions, a first steering cam means (41) for bringing the first selector element (16) and the associated pattern bar (10) to a second position which triggers the floating position of the knitting needles (3) after the first selector element (16) has been moved back from its first position to its initial position by said spring (22) upon the release of said first element (16) by the electromagnetic selector means (33) in accordance with said pattern, and a second steering cam means (42) for bringing the second selector element (17) and the associated pattern bar (10) to a third position which triggers the tucking position of the knitting needles (3) after the second selector element (17) has been moved back from its first position to its initial position by said spring (22) upon the release of said second element (17) by the electromagnetic selector means in accordance with said pattern.

2. A knitting machine as in claim 1 in which said pattern bar (10) has a bulge (21) formed therein and in which said spring (22) is a U-shaped spring disposed in said bulge, said spring having a first leg (23) in engagement with the first selector element (16) and a second leg (24) in engagement with the second selector element (17).

3. A knitting machine as defined in claim 1 in which each of said selector elements (16, 17) comprises a first surface (44) which extends transversely to its direction of displacement and is engageable by the eccentric steering means (39) and a second surface (45) which is oriented substantially perpendicularly to the first surface (44) and which one of the first and second steering cam means respectively (41, 42) engages.

4. A knitting machine as defined in claim 2 in which each of said selector elements (16, 17) comprises a first surface (44) which extends transversely to its direction of displacement and is engageable by the eccentric steering means (39) and a second surface (45) which is oriented substantially perpendicularly to the first surface (44) and which one of the first and second steering cam means respectively (41, 42) engages.

5. A knitting machine as defined in claim 1 in which said eccentric steering means (39) is mounted in an adjustable manner.

6. A knitting machine as in claim 1 in which each of said selector elements (16, 17) comprises a surface (47) which is substantially perpendicular to its direction of displacement and which is engaged by the electromagnetic selector means (33).

7. A knitting machine as in claim 1 in which each of said selector elements (16, 17) comprises a surface (37) which extends at an incline to its direction of displacement and which the electromagnetic selector means (33) engage with a correspondingly inclined surface (38).

8. A knitting machine as in claim 6 including strips (46) made of wear-resistant, non-magnetic material inserted into the surfaces (38, 48) of the electromagnetic selector means (33) which cooperate with the selector elements (16, 17).

9. A knitting machine as in claim 7 including strips (46) made of wear-resistant, non-magnetic material inserted into the surfaces (38, 48) of the electromagnetic selector means (33) which cooperate with the selector elements (16, 17).

10. A knitting machine as defined in any one of claims 1 to 3 in which said electromagnetic selector means (33) comprises electromagnets (36) which are controllable in accordance with a pattern, and respective permanent magnets (35) which hold the selector elements (16, 17) and whose effect on the selector elements (16, 17) can be attenuated by the electromagnets (36) such that the selector elements (16, 17) are returned to their initial positions by the force of the spring (22).

* * * * *